US006340867B1

(12) United States Patent
Kang

(10) Patent No.: US 6,340,867 B1
(45) Date of Patent: Jan. 22, 2002

(54) PLASMA DISPLAY PANEL DRIVING METHOD AND APPARATUS THEREOF

(75) Inventor: Seong Ho Kang, Daeku (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/624,353

(22) Filed: Jul. 24, 2000

(30) Foreign Application Priority Data

Jul. 23, 1999 (KR) ..... P99-30084

(51) Int. Cl.[7] ..... G09G 3/10
(52) U.S. Cl. ..... 315/169.4; 345/47; 345/60
(58) Field of Search ..... 315/169.1, 169.4; 345/60, 63, 47, 204, 206, 205

(56) References Cited

U.S. PATENT DOCUMENTS

| | | | | |
|---|---|---|---|---|
| 3,733,435 A | | 5/1973 | Chodil et al. | 315/169 |
| 4,638,218 A | * | 1/1987 | Shinoda et al. | 315/169.4 |
| 5,835,072 A | | 11/1998 | Kanazawa | 345/60 |
| 5,963,184 A | * | 10/1999 | Tokunaga et al. | 345/60 |
| 6,087,779 A | * | 7/2000 | Sakamotot et al. | 315/169.4 |

OTHER PUBLICATIONS

J.F. Nolan, "A Simple Technique for Obtaining Variable Intensity in AC Plasma Display Panels", Dec. 1, 1975, pp. 385–388, Technical Digest.

* cited by examiner

*Primary Examiner*—Don Wong
*Assistant Examiner*—Thuy Vinh Tran
(74) *Attorney, Agent, or Firm*—Fleshner & Kim, LLP

(57) ABSTRACT

A plasma display panel that is capable of being driven with an analog image signal by an active driving system and a driving method and apparatus thereof driving apparatus are disclosed. In the method, an address voltage corresponding to the image signal is charged in a charge device provided for each cell at an address step. A sustaining discharge is generated during a period proportional to the address voltage charged in the charge device at an automatic firing and sustaining discharge step. Accordingly, the plasma display panel is driven with an analog image signal to reduce the address interval and thus relatively lengthen the discharge sustaining interval, thereby improving the brightness dramatically and preventing the generation of a contour noise caused by a discontinuity of an emitting pattern from the convention digital gray level realization.

42 Claims, 15 Drawing Sheets

PLASMA DISPLAY PANEL DRIVING METHOD AND APPARATUS THEREOF

BACKGROUND OF THE INVENTION

1. Field of the Invention

This invention relates to a plasma display panel, and more particularly to a plasma display panel that can be driven by an active matrix system with an analog image signal. The present invention also is directed to a method and apparatus for driving the PDP.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture. Such a PDP is easy to be made into a thin-film and large-dimension type. Moreover, the PDP provides a very improved picture quality owing to a recent technical development. Such a PDP typically includes a surface-discharge and alternating current (AC) type PDP that has three electrodes as shown in FIG. 1 and is driven with an alternating current voltage.

FIG. 1 is a perspective view of a discharge cell of a conventional three-electrode and AC-type PDP. Referring to FIG. 1, the discharge cell includes an upper substrate 10 provided with a sustaining electrode pair 12 and 14, and a lower substrate 20 provided with an address electrode 22. The upper substrate 10 and the lower substrate 20 are spaced, in parallel to each other, with having a barrier rib 26 therebetween. A mixture gas such as Ne—Xe or He—Xe, etc. is injected into a discharge space defined by the upper substrate 10 and the lower substrate 20 and the barrier rib 26. Any one electrode 12 of the sustaining electrode pair 12 and 14 is used as a scanning/sustaining electrode that responds to a scanning pulse applied in the address interval to cause an opposite discharge along with the address electrode 22, and responds to a sustaining pulse applied in the sustaining interval to cause a surface discharge along with the adjacent sustaining electrode 14. The sustaining electrodes 14 adjacent to the sustaining electrode 12 used as the scanning/sustaining electrode are used as a common sustaining electrode to which a sustaining pulse is applied commonly. On an upper substrate 10 provided with the sustaining electrode pair 12 and 14, an upper dielectric layer 16 and a protective film 18 are disposed. The upper dielectric layer 16 is responsible for limiting a plasma discharge current as well as accumulating a wall charge during the discharge. The protective film 18 prevents a damage of the upper dielectric layer 16 caused by a sputtering generated during the plasma discharge and improves an emission efficiency of secondary electrons. This protective film 18 is usually made from MgO. The address electrode 22 crosses the sustaining electrode pair 12 and 14 and is supplied with a data signal for selecting cell to be displayed. A lower dielectric layer 24 is formed on the lower substrate 20 provided with the address electrode 22. The barrier ribs 26 for dividing the discharge space are extended perpendicularly on the lower dielectric layer 24. The surfaces of the lower dielectric layer 24 and the barrier rib 26 is coated with a fluorescent material 28 excited by a vacuum ultraviolet ray to generate a red, green or blue visible light.

The PDP discharge cell having the structure as described above sustains a discharge by a surface discharge between the sustaining electrode pair 12 and 14 after being selected by an opposite discharge between the address electrode 22 and the scanning/sustaining electrode 12. The fluorescent material 28 is radiated by an ultraviolet ray generated during the sustaining discharge to emit a visible light into the exterior of the cell. In this case, a discharge sustaining interval, that is, a sustaining discharge frequency of the cell is controlled to realize a gray scale required for an image display.

Such a PDP driving method typically includes a sub-field driving method in which the address interval and the discharge sustaining interval are separated. In the sub-field driving method as shown in FIG. 2, one frame is divided into n sub-fields SF1 to SFn corresponding to each bit of an n-bit image data. Each of which is again divided into a reset interval RP, an address interval AP and a discharge sustaining interval SP. The reset interval RP is an interval for initializing a discharge cell, the address interval AP is an interval for generating a selective address discharge in accordance with a logical value of a video data, and the sustaining interval SP is an interval for sustaining interval a discharge at the discharge cell 12 having generated the address discharge. The reset interval RP and the address interval AP are equally allocated in each sub-field interval. A weighting value with a ratio of $2^0:2^1:2^2:\ldots:2^{n-1}$ is given to the discharge sustaining interval SP to express a gray scale by a combination of the discharge sustaining intervals SP.

FIG. 3 is waveform diagrams of driving signals applied to the PDP during a certain one sub-field interval SFi. In the reset interval RP, a priming pulse Pp is applied to the common sustaining electrode. By this priming pulse Pp, a reset discharge is generated between each common sustaining electrode and each scanning/sustaining electrodes of the entire discharge cells to initialize the discharge cells. At this time, a voltage pulse lower than the priming pulse Pp is applied to the address electrode so as to prevent a discharge between the address electrode and the common sustaining electrode. By the reset discharge, a large amount of wall charges are formed at the common sustaining electrode and the scanning/sustaining electrode of each discharge cell. Subsequently, a self-erasure discharge is generated at the discharge cells by the large amount of wall charges to eliminate the wall charges and leave a small amount of charged particles. These small amount of charged particles help an address discharge in the following address interval. In the address interval AP, a scanning voltage pulse SCp is applied line-sequentially to the first to mth scanning/sustaining electrodes. At the same time, a data pulse Dp according to a logical value of a data is applied to the address electrodes. Thus, an address discharge is generated at discharge cells to which the scanning voltage pulse SCp and the data pulse Dp are simultaneously applied. Wall charges are formed at the discharge cells in which the address discharge has been generated. During this address interval, a desired constant voltage is applied to the common sustaining electrodes to prevent a discharge between each address electrode and each common sustaining electrode. In the sustaining interval SP, a sustaining pulse Sp is alternately applied to the first to mth scanning/sustaining electrodes and the common sustaining electrodes. Accordingly, a sustaining discharge is generated continuously only at the discharge cells formed with the wall charges by the address discharge to emit a visible light.

In such a sub-field driving method, the reset interval RP is set for each sub-field to initialize the discharge cells in the same state. Due to the reset interval RP, however, a spurious light-emission that does contribute to the brightness is generated at the rising and falling edges of the reset voltage pulse Pp every sub-field SF1 to SFn. A brightness of a black level rises from such a spurious emission to lower the contrast. In order to overcome this contrast deterioration, a scheme of including one reset interval per frame or a reset interval having a lower frequency than the prior art, that is, a full writing period FWP as shown in FIG. 4 has been disclosed in Japanese Laid-open Patent Gazette No. Pyung 5-313598.

In the PDP adopting the sub-field driving method, the brightness is determined by the display interval, that is, the discharge sustaining interval. Since a relatively long time is wasted due to the address interval allocated equally for each sub-field SF1 to SFn, however, a time allocated for the discharge sustaining interval determining the brightness lacks. For instance, when 480 lines are scanned by a scanning voltage pulse with a width of 3 m in the address interval of each sub-field, a time of about 1.44 ms is required. Accordingly, since a time of about 12 ms (i.e., 1.44 ms×8) is allocated for the total address interval when 16.7 ms is allocated for on frame display interval consisting of 8 sub-fields so as to display a 8-bit image data, a time of about 4 ms is allocated for the discharge sustaining interval except for the reset interval. As a result, the conventional PDP has a problem in that the brightness is low due to a relative lack of the discharge sustaining interval determining the brightness. Furthermore, when it is intended to implement a screen with a high resolution, a discharge sustaining interval becomes more lack due to an increase in the address interval according to an increase in the scanning lines to make the display itself impossible.

In addition, the PDP has a problem in that, since a light emitting by a discharge time modulation system is superposed to display a picture, a contour noise is generated due to a discordance between an integration direction of a light assumed in the driving method and a visual characteristic recognized by the eyes of human. The contour noise usually appears in the shape of a black stripe or a white stripe between the frames. For instance, the contour noise is generated when gray levels having a large emitting pattern difference between the frames such as 127–128, 63–64 and 31–32, etc. are displayed continuously. More specifically, if the frames corresponding to 128–127 are continuous, then a large movement of an emitting position is generated because a brightness level difference between two frame is not large, but a time difference between the emitting pattern is large. In this case, since the eyes of an observer fail to keep up with the movement of this emitting position, a bright stripe is observed between two frames under a real visual state. Even when frames corresponding to 127–128 are continuous, a black stripe is observed due to the same cause. Since the most amounts of such a contour noise is generated when an object with a human body color is moved, the contour noise is founded abundantly at a moving picture caused by a movement of a human's face or body. Also, there is a problem in that, when a color picture is displayed, a color balance is lowered to cause a deterioration of the picture.

SUMMARY OF THE INVENTION

Accordingly, it is an object of the present invention to provide a plasma display panel (PDP) that can be driven with an active system by accumulating a voltage corresponding to an analog video signal for each discharge cell.

A further object of the present invention is to provide a PDP driving method that is capable of driving the above-mentioned PDP by an active system.

A still further object of the present invention is to provide a PDP driving method that is capable of reducing an address interval as well as enlarging a discharge sustaining interval by using a single field configuration according to an analog driving system.

A still further object of the present invention is to provide a PDP driving method that is capable of displaying many gray levels by using a plurality of sub-field configuration according to an analog driving system.

In order to achieve these and other objects of the invention, a plasma display panel according to one aspect of the present invention includes a plurality of cells driven with an analog image signal, each of which comprises a sustaining electrode pair arranged in parallel for a sustaining discharge; a charge device for charging an address voltage corresponding to the image signal to initiate the sustaining discharge along with any one electrode of the sustaining electrode pair; and a discharge space into which a discharge gas is injected to cause a gas discharge.

A method of driving a plasma display panel according to another aspect of the present invention including a plurality of cells driven with an analog image signal comprises an addressing step for charging an address voltage corresponding to the image signal into a charge device provided for each of said cells; and an automatic firing and sustaining discharge step for generating a sustaining discharge during a period proportional to an address voltage charged in the charge device.

A method of driving a plasma display panel according to still another aspect of the present invention including a plurality of cells using an analog image signal, comprises the steps of: charging the analog image signal into a charge device; generating an address voltage pulse at the different timing in accordance with a voltage charged into the charge device; and initiating and maintaining a sustaining discharge responding to the address voltage pulse.

A driving apparatus for a plasma display panel according to still another aspect of the present invention including a plurality of cells driven with an analog image signal, wherein each of the cells in the plasma display panel includes first and second sustaining electrodes, a charge device for charging an address voltage corresponding to the image signal to initiate the sustaining discharge along with any one electrode of the first and second sustaining electrodes, and a discharge space into which a discharge gas is injected to cause a gas discharge, comprises a first sustaining driver for applying a firing voltage pulse for initiating the sustaining discharge and a sustaining voltage pulse for making the sustaining discharge to the first sustaining electrode; a second sustaining driver for applying a scanning voltage pulse for a switching discharge, the firing voltage pulse and the sustaining voltage pulse to the second sustaining electrode; and an address driver for applying the address voltage pulse to an address electrode included in the charge device and for applying a specific voltage changing with the lapse of time to the address electrode when the firing voltage pulse and the sustaining electrode pulse are coupled.

A driving apparatus for a plasma display panel according to still another aspect of the present invention including a plurality of cells using an analog image signal, comprising: an address driving circuit including a charge device charging the image signal, the address driving circuit generating an address voltage pulse at a timing shifted with a voltage charged into the charge device and applying the address voltage pulse to an address electrode in each cell; and a sustain driving circuit for applying a fire voltage pulse and a sustain voltage pulse to a pair of sustain electrodes, the fire voltage pulse initiating a sustain discharge with the address voltage pulse, the sustain voltage pulse generating continuously the sustain discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
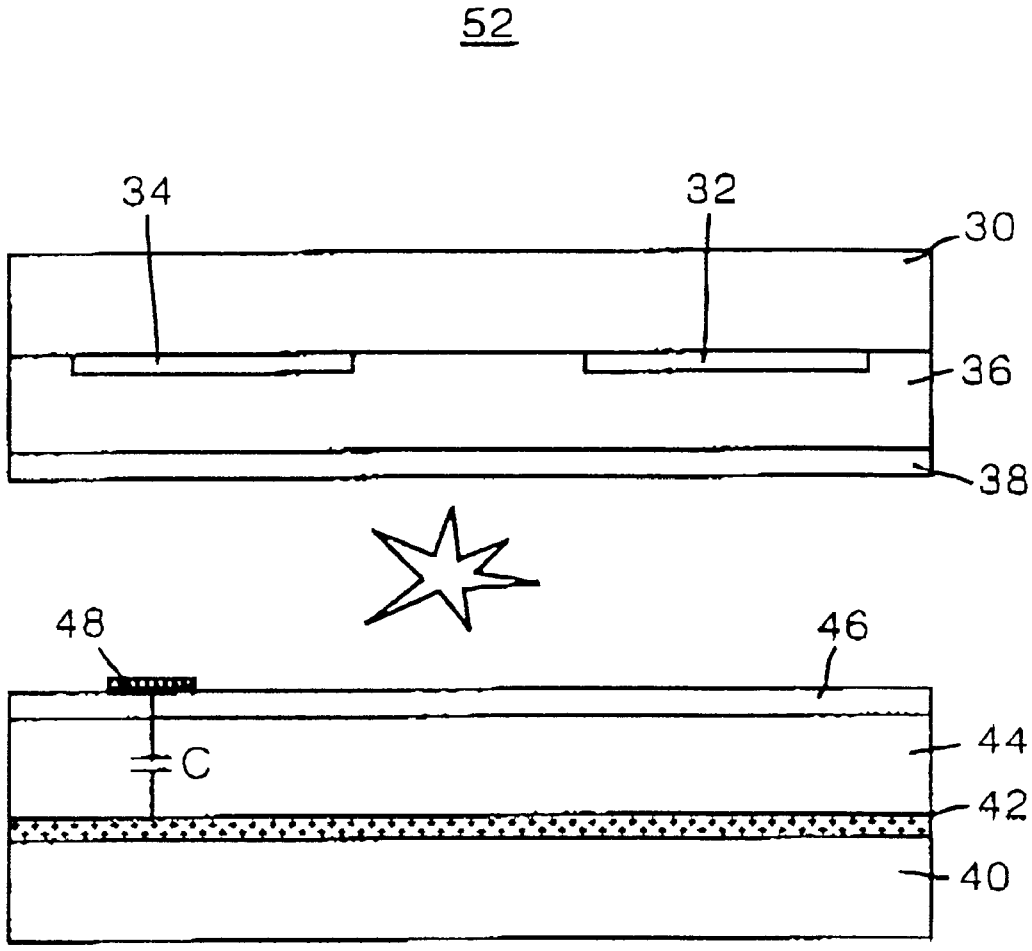
FIG. 4 is a section view showing a structure of a discharge cell of a plasma display panel according to an embodiment of the present invention.
Figure 5A:
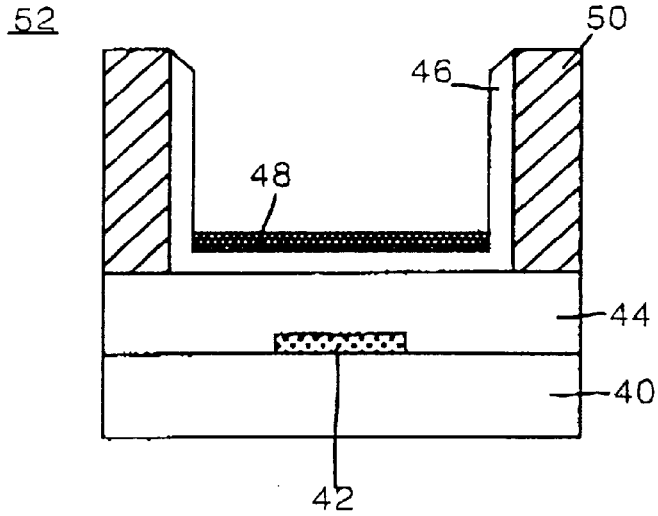
FIG. 5A and FIG. 5B are a section view and a plan view showing a structure of a lower plate when the discharge cell in FIG. 4 is viewed in other direction, respectively.
Figure 5B:
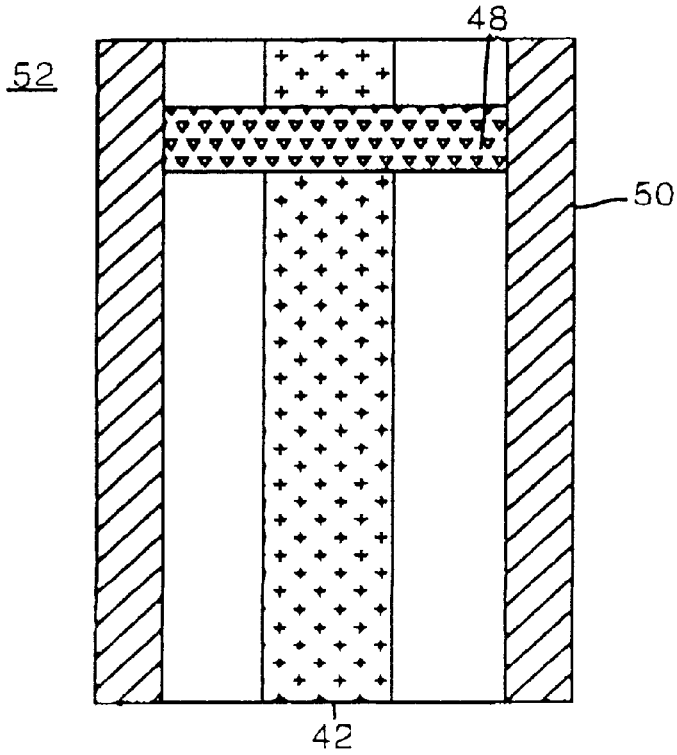

FIG. 4 is a section view showing a structure of a discharge cell of an active PDP according to an embodiment of the present invention. FIGS. 5A and 5B are a section view and a plan view showing a structure of a lower plate when the discharge cell is viewed in other direction, respectively. Referring to FIG. 4 and FIGS. 5A and 5B, the discharge cell 52 includes a upper substrate 30 provided with a sustaining electrode pair 32 and 34, and a lower substrate 40 provided with an address electrode 42. The upper substrate 30 and the lower substrate 40 are spaced, in parallel to each other, with having a barrier rib 50 therebetween. A mixture gas such as Ne—Xe or He—Xe, etc. is injected into a discharge space defined by the upper substrate 30, the lower substrate 40 and the barrier rib 50. Any one electrode 32 of the sustaining electrode pair 32 and 34 is used as a scanning/sustaining electrode that responds to a scanning pulse applied in the address interval to cause an opposite discharge along with the address electrode 42, and responds to a sustaining pulse applied in the sustaining interval to cause a surface discharge along with the adjacent sustaining electrode 34. The sustaining electrode 34 adjacent to the sustaining electrode 32 used as the scanning/sustaining electrode is used as a common sustaining electrode to which a sustaining pulse is applied commonly. On an upper substrate 30 provided with the sustaining electrode pair 32 and 34, an upper dielectric layer 36 and a protective film 38 are disposed. The upper dielectric layer 36 is responsible for limiting a plasma discharge current as well as accumulating a wall charge during the discharge. The protective film 38 prevents a damage of the upper dielectric layer 36 caused by a sputtering generated during the plasma discharge and improves an emission efficiency of secondary electrons. This protective film 38 is usually made from MgO. The address electrode 42 crosses the sustaining electrode pair 32 and 34 and is supplied with the corresponding video signal with a shape of analog. A lower dielectric layer 44 for limiting a discharge current and accumulating wall charges is formed on the lower substrate 40 provided with the address electrode 42. The barrier ribs 50 for dividing the discharge space are perpendicularly extended, in parallel to the address electrode 42, on the lower dielectric layer 44. The surfaces of the lower dielectric layer 44 and the barrier rib 50 is coated with a fluorescent material 46 excited by a vacuum ultraviolet ray to generate a red, green or blue visible light. An address auxiliary electrode 48 is provided in a direction crossing the address electrode 42 on the fluorescent material 46. This address auxiliary electrode 48 causes a discharge along with any one electrode 34 of the sustaining electrode pair 32 and 34 and forms a capacitor C with having the address electrode 42 and the dielectric layer 44 therebetween. When the address auxiliary electrode 48 causes a discharge along with the common sustaining electrode 34, it is arranged in parallel to the common sustaining electrode 34 as shown in FIG. 4. The address auxiliary electrode 48 is formed separately for each discharge cell unlike other electrodes. For this reason, the capacitor C can charge an independent video signal for each cell. In other words, the capacitor C charges a video signal applied to the address electrode 42 in the address interval for each cell to sustain the discharge in proportion to a magnitude of the video signal in the later discharge sustaining interval. Accordingly, the PDP charges an analog video signal for each cell and sustains the discharge in proportion to a magnitude of the charged video signal, thereby displaying the gray levels.

Figure 6:
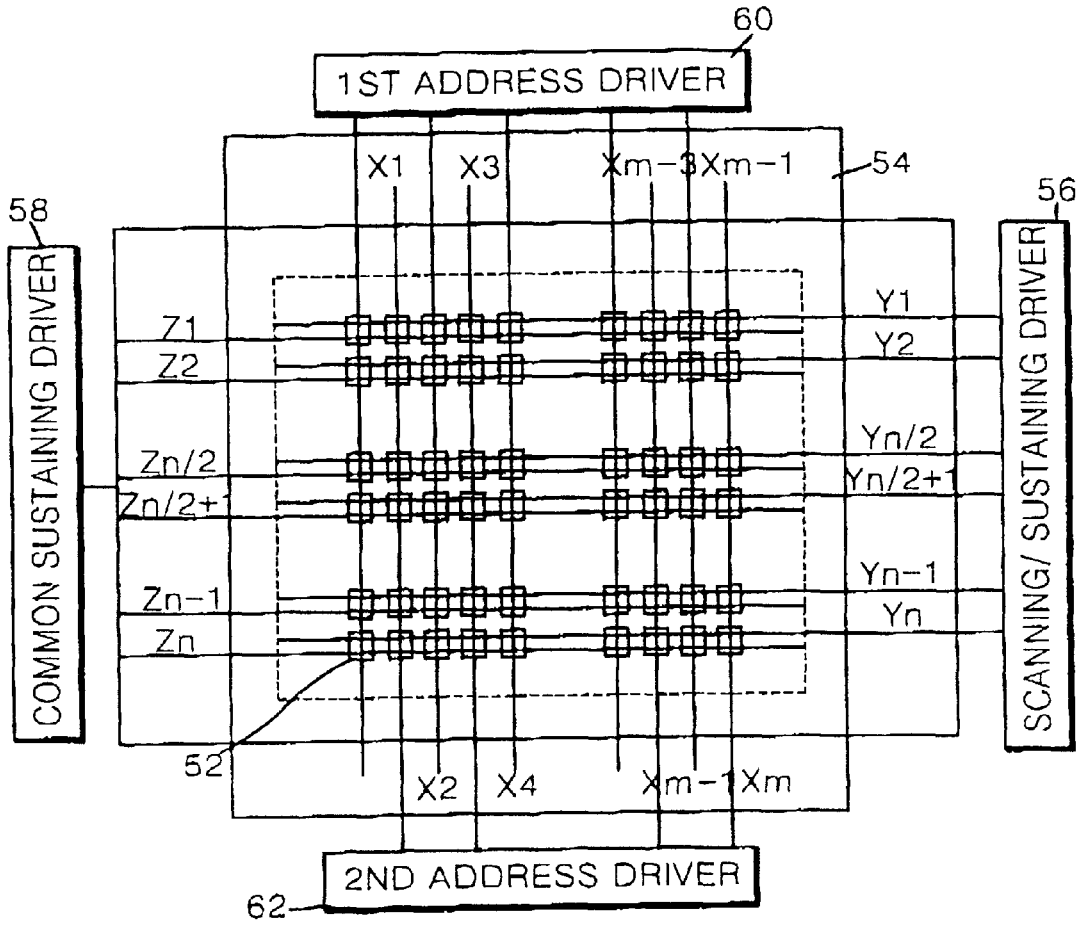
FIG. 6 is a schematic block diagram showing a configuration of a driving apparatus for a plasma display panel according to an embodiment of the present invention.

Referring now to FIG. 6, there are shown a PDP 54 having discharge cells of FIG. 5 arranged in a matrix type and driving circuit blocks therefor. In the PDP 54, n scanning/sustaining electrode lines Y1 to Yn, each of which consists of the scanning/sustaining electrode 32 in FIG. 5, are arranged in parallel to n common sustaining electrode lines Z1 to Zn, each of which consists of the common sustaining electrode 34. Also, m address electrode lines X1 to Xm, each of which consists of the address electrode 42, are arranged in a direction crossing the electrode lines Y1 to Yn and Z1 to Zn. The intersections among the electrode lines Y1 to Yn, Z1 to Zn and X1 to Xm are provided with the discharge cells 52 as shown in FIG. 5. The driving circuit for the PDP 54 includes a scanning/sustaining driver 56 for driving the m scanning/sustaining electrode lines Y1 to Yn, a common sustaining driver 57 for driving the n common sustaining electrode lines Z1 to Zn commonly connected via a single electrode line, and first and second address drivers 60 and 62 for making a divisional driving of the m address electrode lines X1 to Xm. The scanning/sustaining driver 56 applies a scanning voltage pulse for an address discharge, an erasure voltage pulse for erasing wall charges and a discharge sustaining voltage pulse for a discharge sustaining to each of the scanning/sustaining electrode lines Y1 to Yn. The common sustaining driver 58 applies a reset voltage pulse for a reset discharge and a discharge sustaining voltage pulse for a discharge sustaining commonly to the common sustaining electrode lines Z1 to Zn. The first address driver 60 applies a reset voltage pulse for a reset discharge, a video signal and a ramp signal to each of the odd-numbered address electrode lines X1, X3, . . . , Xm−1. The second address driver 62 applies a reset voltage pulse for a reset discharge, a video signal and a ramp signal to each of the even-numbered address electrode lines X2, X4, . . . , Xm.

Figure 7:
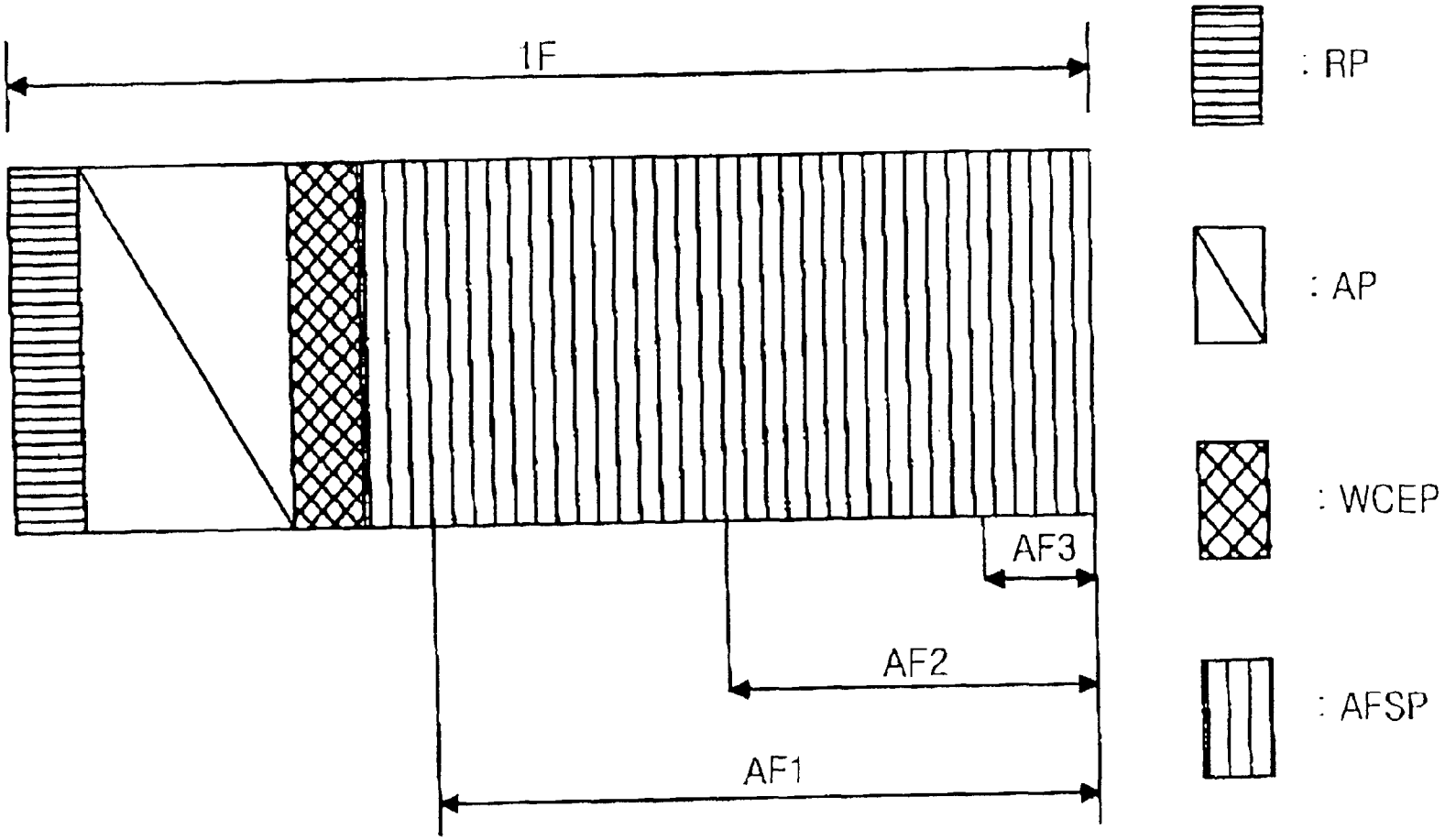
FIG. 7 illustrates a configuration of one frame for providing a gray level display of the plasma display panel according to the embodiment of the present invention.

As the PDP having the configuration as described above is driven with an analog video signal by an active system, one frame 1F consists of one reset interval RP, an address interval AP, and an automatic firing and discharge sustaining interval AFSP as shown in FIG. 7. The reset interval RP is a period for initializing the discharge cells. The address interval AP is a period for charging the corresponding video signal for each discharge cell while scanning the discharge cells by a scanning voltage pulse. The automatic firing and discharge sustaining interval AFSP is a period for initiating a discharge from a time when more than a discharge start voltage is loaded into the discharge space and sustaining the discharge. In this case, a discharge initiating time is differentiated depending on a magnitude of the video signal charged for each discharge cell in the address interval AP, so that a gray level can be displayed. In other words, as a magnitude of the video signal charged in the address interval AP goes larger, a time initiating a discharge in the automatic firing and discharge sustaining interval AFSP becomes faster. Thus, a discharge sustaining interval is lengthened to such an extent that the discharge initiating time becomes fast, so that a high gray level can be displayed. In FIG. 7, AF1 to AF3 represent intervals for initiating a discharge at the discharge cell in such a sequence that the charged video signal has a smaller magnitude and sustaining the discharge. A wall charge erasure interval WCEP for erasing wall charges formed at the upper plate is further included between the address interval AP and the automatic firing and discharge sustaining interval AFSP. The PDP driving method adopting such an analog system will be described in detail below with reference to the PDP driving waveforms shown in FIG. 8 and a driving mechanism shown in FIGS. 9A to 9U.

Figure 8:
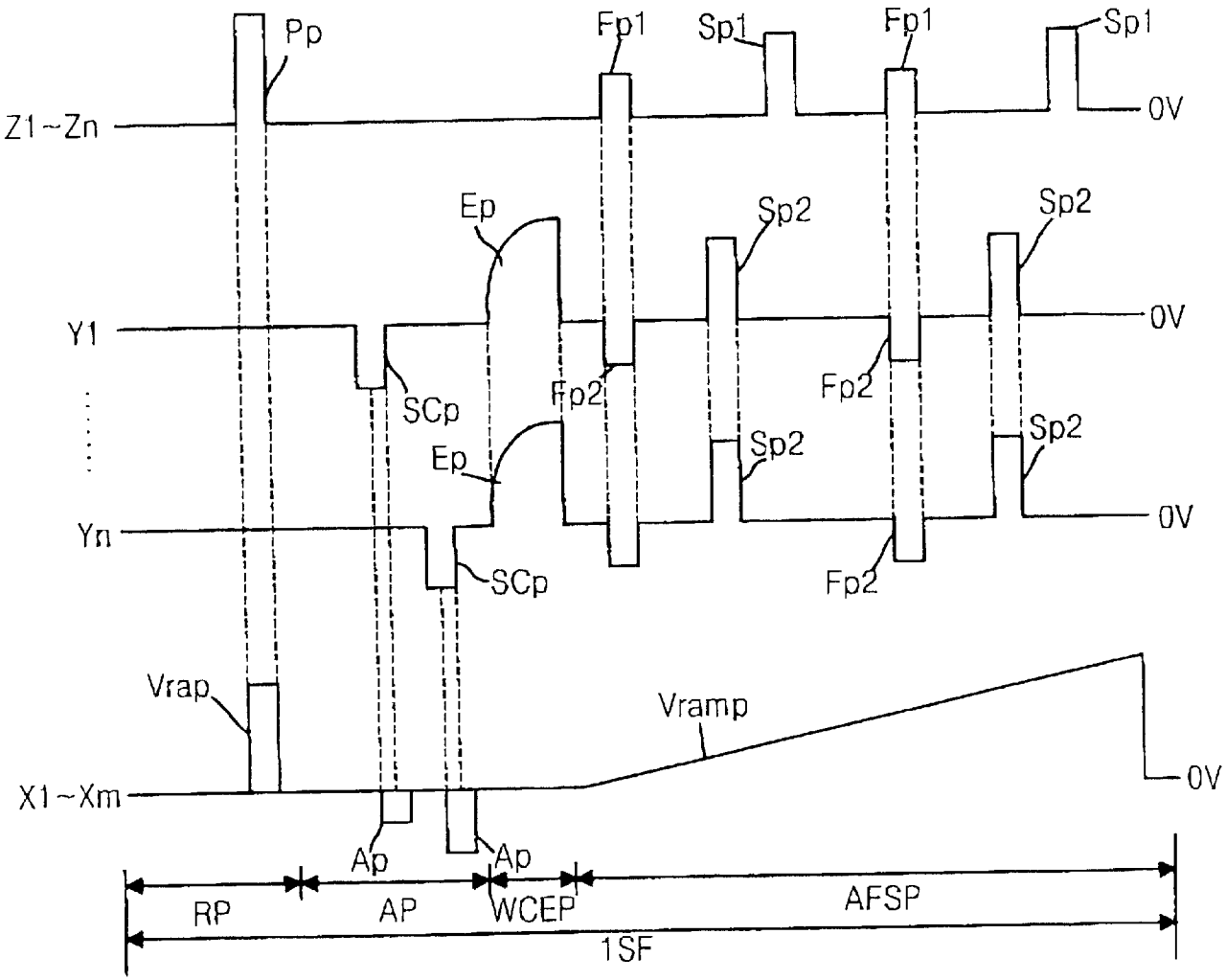
FIG. 8 is waveform diagrams of driving signals applied to the plasma display panel during one frame interval shown in FIG. 7.
Figure 9A:
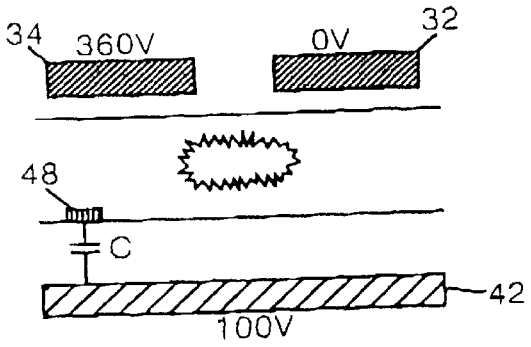
FIG. 9A to FIG. 9U show a driving mechanism of the discharge cell shown in FIG. 4 step by step in accordance with the driving waveforms in FIG. 8.
Figure 9B:
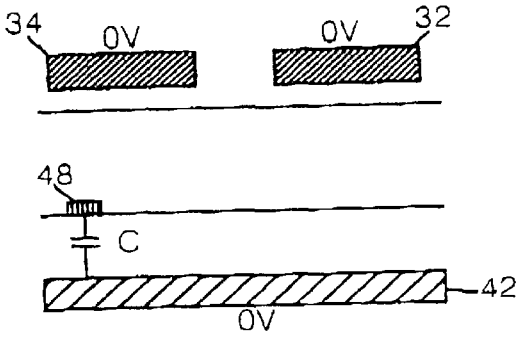
Figure 9C:
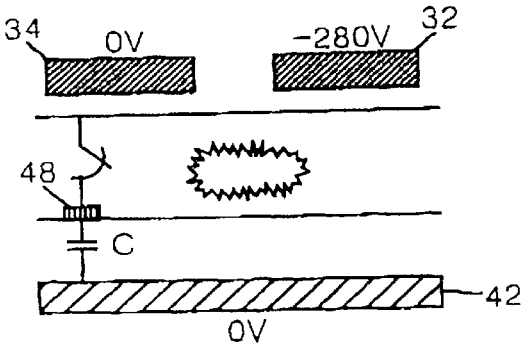
Figure 9D:
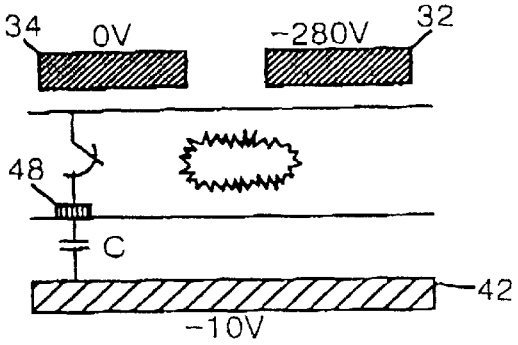
Figure 9E:
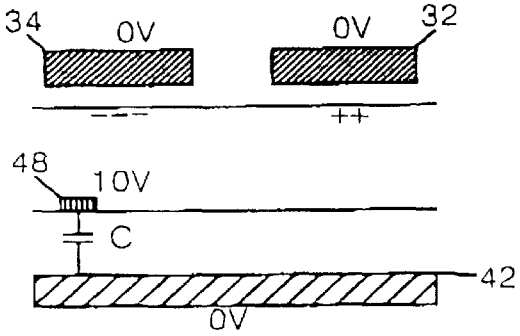
Figure 9F:
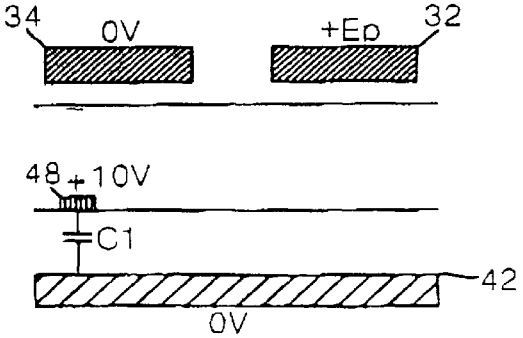
Figure 9G:
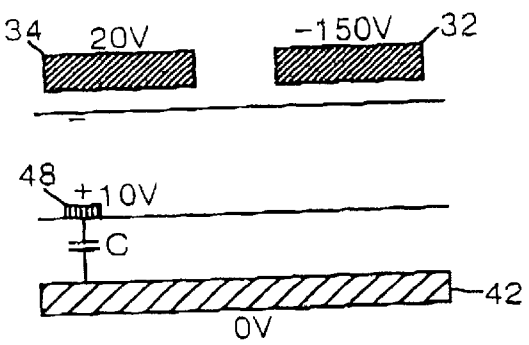
Figure 9H:
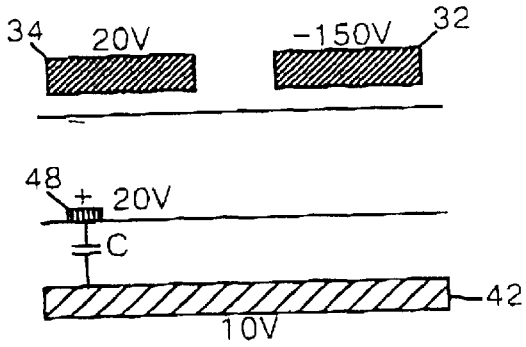
Figure 9I:
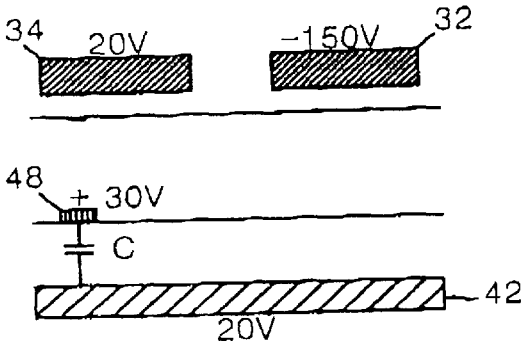
Figure 9J:
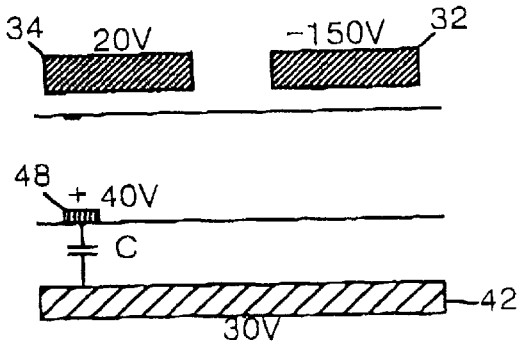
Figure 9K:
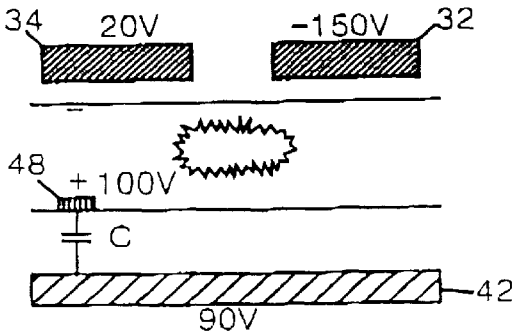
Figure 9L:
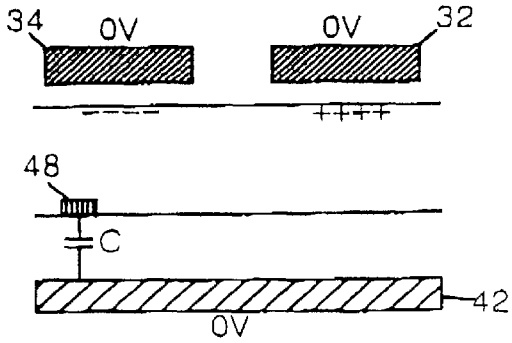
Figure 9M:
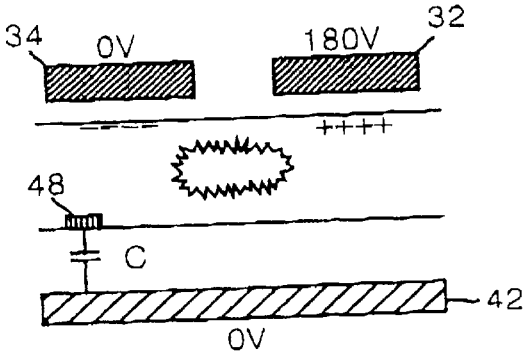
Figure 9N:
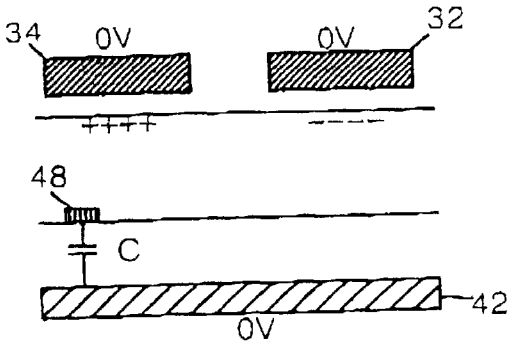
Figure 9O:
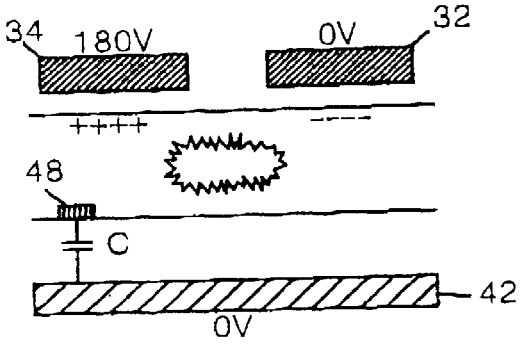
Figure 9P:
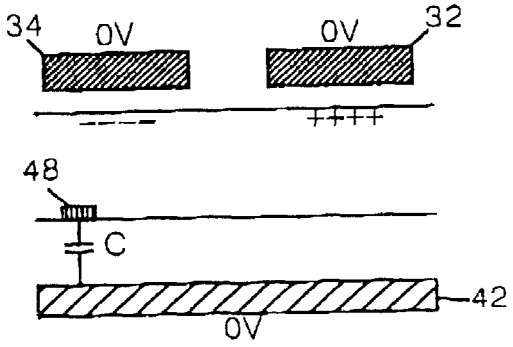
Figure 9Q:
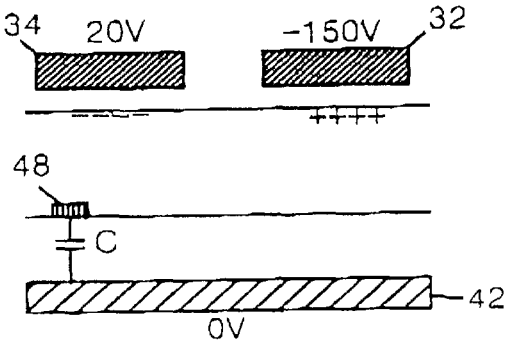
Figure 9R:
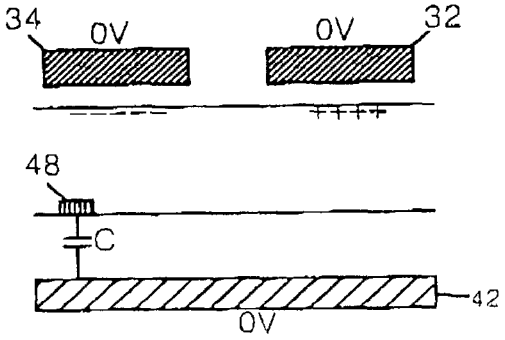
Figure 9S:
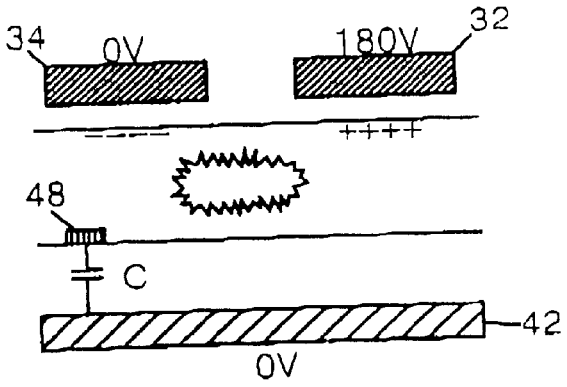
Figure 9T:
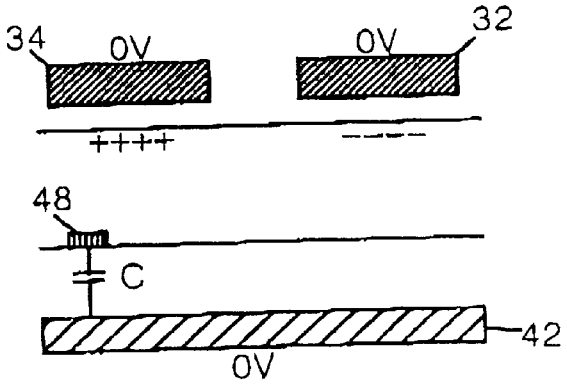
Figure 9U:
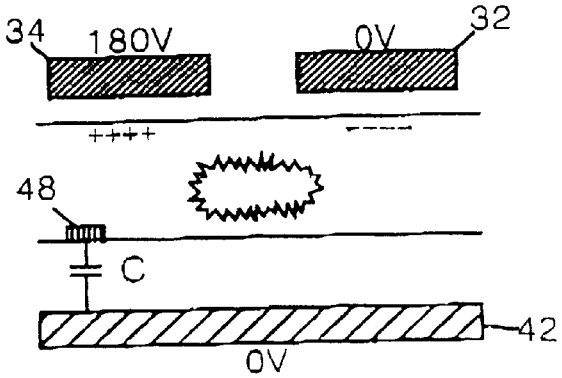

FIG. 8 illustrates driving waveforms applied to the corresponding electrode lines from the driving circuits shown in FIG. 6 during one frame (1F) interval. FIGS. 9A to 9U show a driving mechanism according to the driving waveforms in FIG. 8 during one frame (1F) period at a certain discharge cell step by step.

First, in the reset interval RP, the common sustaining driver 58 in FIG. 6 applies a reset voltage pulse Pp to the common sustaining electrode lines Z1 to Zn to cause a reset discharge as shown in FIG. 9A at all the discharge cells. The reset voltage pulse Pp has a width of 2 to 3 $\mu$s and a voltage of about 360V. By this reset discharge, desired wall charges are formed at the sustaining electrode pairs 32 and 34 in all the discharge cells. At this time, the first and second address drivers 60 and 62 apply a desired voltage pulse Vrap to the address electrode lines X1 to Xm. The voltage pulse Vrap prevents a discharge between the sustaining electrode pair 32 and 34 and the address electrode 42 to reduce an emission magnitude during the reset discharge. Subsequently, a self-erasure discharge is generated without any external applying voltage by the wall charges formed at the sustaining electrode pair 32 and 34 to erase the wall charge as shown in FIG. 9B.

Next, in the address interval AP, the scanning/sustaining driver 56 applies a negative scanning voltage pulse SCp line-sequentially to the scanning/sustaining electrode lines Yl to Yn. At the same time, the common sustaining driver 58 applies a zero voltage 0V to the common sustaining electrode lines Z1 to Zn. A switching discharge is generated as shown in FIG. 9C at the discharge cell to which the scanning voltage pulse SCp is applied to produce a plasma at the discharge space. A plasma channel having a zero voltage 0V like the common sustaining electrode 34 is formed in almost all discharge space areas except for the vicinity of the scanning/sustaining electrode 32 by the plasma, thereby turning on a plasma switch. By the turned-on plasma switch, the address electrode 42 at the lower plate is electrically shorted to the common sustaining electrode 54. At this time, the first and second address drivers 60 and 62 apply a negative address pulse Ap corresponding to a video signal to the address electrode lines X1 to Xm to charge the corresponding address voltage in the capacitor C provided for each discharge cell. For instance, if an address pulse AP with a voltage of −10V is applied to the address electrode 42 as shown in FIG. 9D, then the address voltage is charged in the capacitor C consisting of the address electrode 42, the address auxiliary electrode 48 and the dielectric layer 44 therebetween. Further, a plasma (i.e., charged particles) produced by the switching discharge passes through a discharge path formed between the sustaining electrode pair 32 and 34 in accordance with the polarity of the sustaining electrode pair 32 and 34 to form wall charges on the upper dielectric layer 18 as shown in FIG. 9E. A voltage applied between the sustaining electrode pair 32 and 34 is cancelled by the wall charges to reduce a discharge voltage loaded into the discharge space, thereby stopping the discharge and turning off the plasma switch at the discharge space. Accordingly, the address auxiliary electrode 48 goes into a floating state to sustain the address voltage charged in the capacitor C. As described above, the plasma channel is provided to charge the corresponding address voltage in the capacitor C at each discharge cell in the address interval AP, and then the charged address voltage is applied to the address auxiliary electrode 48.

In the wall charge erasing interval WCEP following such an address interval AP, the scanning/sustaining driver 56 simultaneously applies an erasure voltage pulse Ep to the scanning/sustaining electrode lines Y1 to Yn. By this erasure voltage pulse Ep, the wall charges formed on the upper dielectric layer 36 are erased as shown in FIG. 9F. As the erasure voltage pulse Ep has a shape of increasing at a slow slope with a lapse of time as shown in FIG. 8, the wall charges are erased with no discharge. Herein, it is desirable that a maximum voltage value of the erasure voltage pulse Ep is less than a voltage value of the reset voltage pulse Pp and more than a voltage value causing the self-erasure discharge.

Consequently, in the automatic firing and discharge sustaining interval AFSP, the first and second address drivers 60 and 62 applies a ramp voltage having a voltage level rising with a lapse of time to the address electrode lines X1 to Xm. At the same time, the common sustaining driver 58 applies a first firing voltage pulse Fp1 and a first sustaining voltage pulse Sp1 alternately to the common sustaining electrode lines Z1 to Zn. Herein, the first firing voltage pulse Fp1 has a lower level than the first sustaining voltage pulse Sp1 and the same positive polarity as the first sustaining voltage pulse Sp1. For instance, a voltage of the first firing voltage pulse Fp1 is set to about 20V while the first sustaining voltage pulse Sp1 is set to about 180V. The scanning/ sustaining driver 56 applies a second firing voltage pulse Fp2 and a second sustaining voltage pulse Sp2 alternately to the scanning/sustaining electrode lines Y1 to Yn. Herein, the second firing voltage pulse Fp2 has a lower level than and a polarity contrary to the second sustaining voltage pulse Sp2. For instance, a voltage of the second firing voltage pulse Fp2 is set to about −150V while a voltage of the second sustaining voltage pulse Sp2 is set to about 180V. The negative polarity of second firing voltage pulse Fp2 has a phase identical to the first firing voltage pulse Fp1 while the positive polarity of second sustaining voltage pulse Sp2 has a phase different from the first sustaining voltage pulse Sp1. A voltage loaded to the address auxiliary electrode 48 also increases in proportion to an increase in a voltage applied to the address electrode 48 as shown in FIGS. 9H to 9J. For this reason, when a voltage difference between the address auxiliary electrode 48 and the scanning/sustaining electrode 32 is more than discharge start voltage 250V, a sustaining discharge is initiated as shown in FIG. 9K. Charged particles produced by this discharge are accumulated into a shape of wall charge on the upper dielectric layer 36 around the sustaining electrode pair 32 and 34 as shown in FIG. 9L. In this case, a negative polarity of wall charge is formed at the common sustaining electrode 34 to which a positive voltage is applied, whereas a positive polarity of wall charge is formed at the scanning/sustaining electrode 32 to which a negative voltage is applied. Subsequently, if the second sustaining voltage pulse Sp2 applied to the scanning/sustaining electrode 32 is coupled, then the voltage is added to the wall charge to generate a sustaining discharge as shown in FIG. 9M. Charged particles produced by this sustaining discharge are accumulated into a shape of wall charge on the upper dielectric layer 36 as shown in FIG. 9N. In this case, unlike FIG. 9L, a positive polarity of wall charge is formed at the common sustaining electrode 34, whereas a negative polarity of wall charge is formed at the scanning/sustaining electrode 32. Next, a sustaining discharge is generated by the second sustaining voltage pulse Sp2 applied to the common sustaining electrode 34 as shown in FIG. 9O to form a wall charge on the upper dielectric layer 36 as shown in FIG. 9P. Such a wall charge is maintained as shown in FIG. 9Q and FIG. 9R during a following time interval when the firing voltage pulses Fp1 and Fp2 are applied to the sustaining electrode pair 32 and 34. A sustaining discharge is continuously generated by the sustaining voltage pulses Sp1 and Sp2 applied alternately to the sustaining electrode pair 32 and 34 as shown in FIG. 9S to FIG. 9U. Such a sustaining discharge initiate other timing in accordance with an address voltage charged in the capacitor C for each discharge cell in correspondence to a video signal in the address interval Ap to be sustained during a time interval when the sustaining voltage pulses Sp1 and Sp2 are applied to the sustaining electrode pair 32 and 34. For instance, as the charged address voltage goes higher, a time initiating the sustaining discharge becomes faster and the discharge sustaining interval is lengthened to such an extent that the discharge initiating time becomes fast. Accordingly, a visible light is emitted from each discharge cell in proportion to the sustaining discharge interval, so that the corresponding gray level is displayed.

As described above, in the PDP according to the present invention, as an analog video signal is supplied for each discharge cell to display the corresponding gray level, one frame interval consists of a reset interval, an address interval and a discharge sustaining interval. Thus, the address interval is reduced into 1/n (wherein n represents the bit number of a data) in comparison to the conventional sub-field driving method driven with a digital data signal. As a result, the discharge sustaining interval is relatively lengthened to improve the brightness dramatically. Also, a contour noise caused by a discontinuity of the emitting pattern from the conventional digital gray level implementation is not generated. In addition, the emission frequency in the reset interval is reduced into 1/n in comparison to the conventional sub-field driving method to decrease a black level, so that the contrast can be improved. Particularly, the PDP according to the present invention can be driven with an analog video signal, so that a middle gray level having a difficulty in realization due to an increase in the number of sub-fields in the conventional sub-field driving method also can be displayed.

Figure 10:
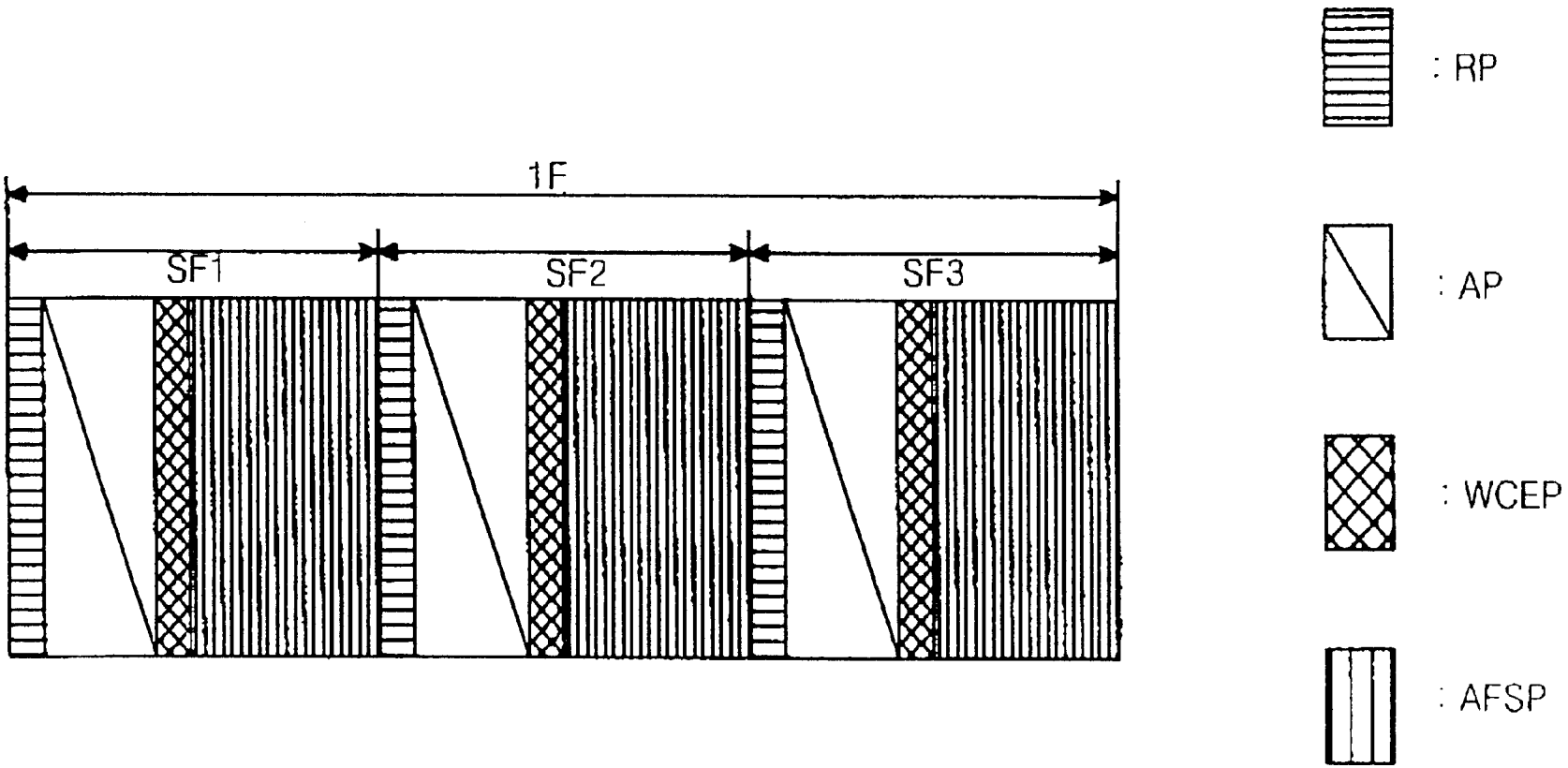
FIG. 10 illustrates a configuration of one frame for providing a gray level display of a plasma display panel according to another embodiment of the present invention.

FIG. 10 shows a configuration of one frame 1F applicable to a PDP driving method according to another embodiment of the present invention. Referring to FIG. 10, one frame 1F consists of a plurality of sub-fields, for example, three sub-fields SF1 to SF3. Each sub-field SF1 to SF3 consists of a reset interval RP, an address interval AP and an automatic firing and discharge sustaining interval AFSP like the configuration of the above-mentioned one frame 1F. A wall charge erasure interval WSEP follows the address interval AP.

Figure 11:
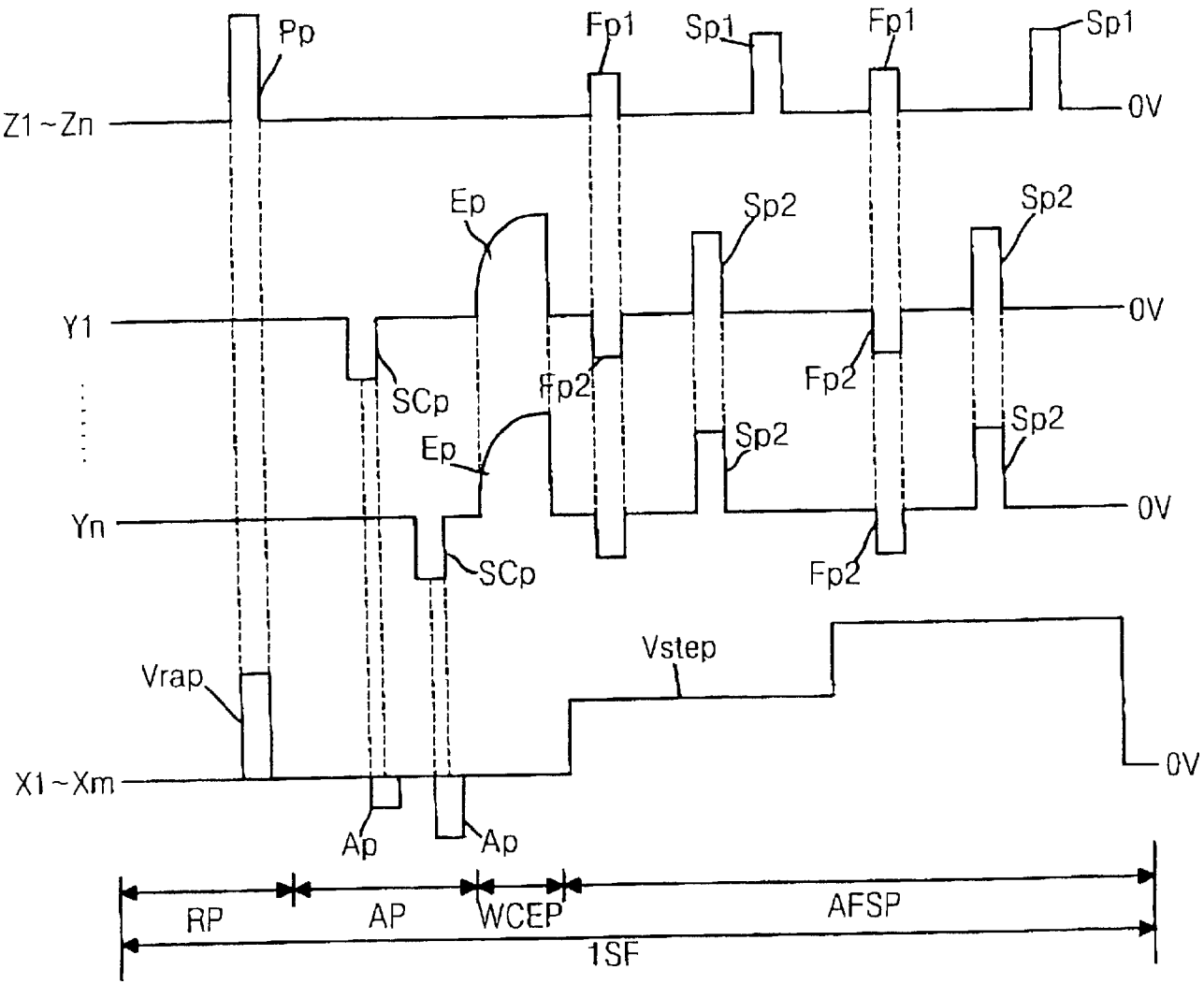
FIG. 11 is waveform diagrams of driving signals applied to the plasma display panel during one frame interval shown in FIG. 10.

FIG. 11 shows driving waveforms applied to the PDP during a specific sub-field interval SF1 shown in FIG. 10. When the driving waveforms shown in FIG. 11 are compared with the driving waveforms shown in FIG. 8, they are identical to each other except that a step voltage Vstep instead of the ramp voltage Vramp is applied to the address electrode lines X1 to Xm during the automatic and discharge sustaining interval AFSP. Since a driving mechanism of the PDP using such driving waveforms is identical to that as described above, an explanation as to the driving mechanism will be omitted. The step voltage Vstep is set to increase by about 5V to 10V unit in accordance with a characteristic of the PDP.

When it is assumed that 10-grade gray levels are realized in such a specific sub-field SF1, at least 1000-grade gray levels can be expressed at one frame 1F consisting of three sub-fields SF1 to SF3 as shown in FIG. 10. In this case, a ratio of the sustaining discharge frequency at the first to third sub-fields SF1 to SF3 can be set to 9:90:900. Otherwise, assuming that one frame consists of five sub-fields capable of expressing 10-grade gray levels, 310-grade gray levels can be expressed when a ratio of the sustaining discharge frequency is set to 100:50:10:50:100. As described above, gray level with more grades can be expressed when one frame consists of a plurality of sub-fields, so that a middle gray level can be expressed more distinctly.

Figure 1:
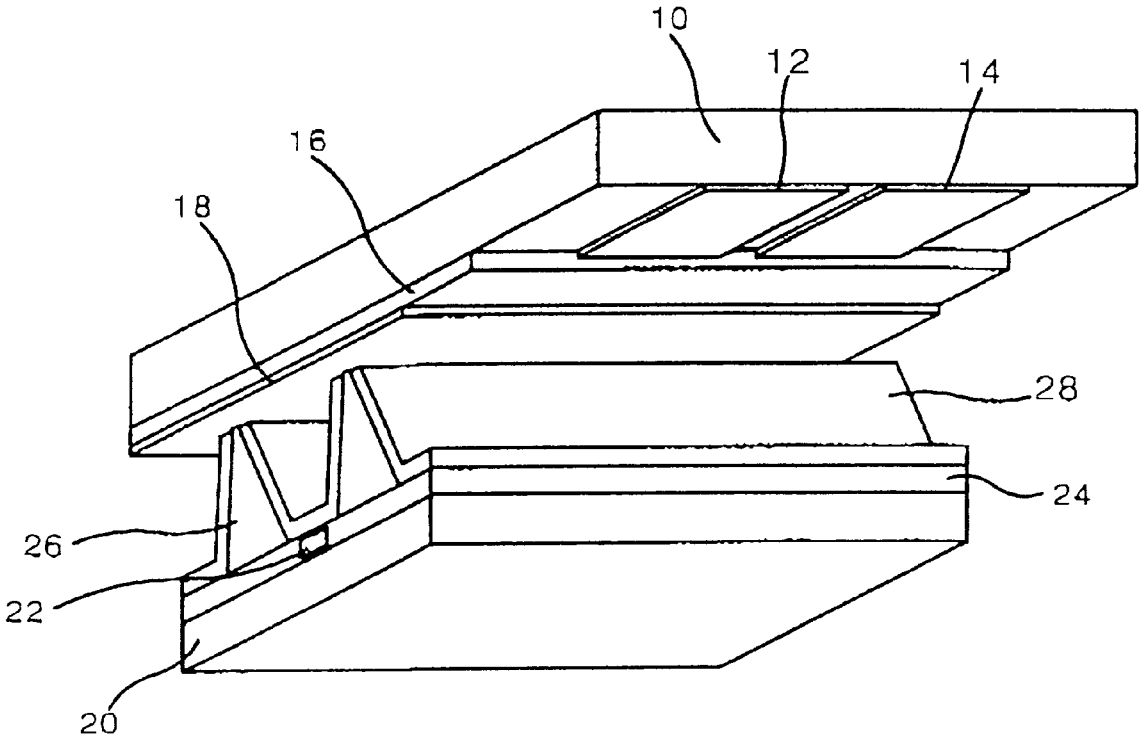
FIG. 1 PRIOR ART
FIG. 1 is a perspective view showing a structure of a discharge cell of a conventional surface discharge type plasma display panel.
Figure 2:
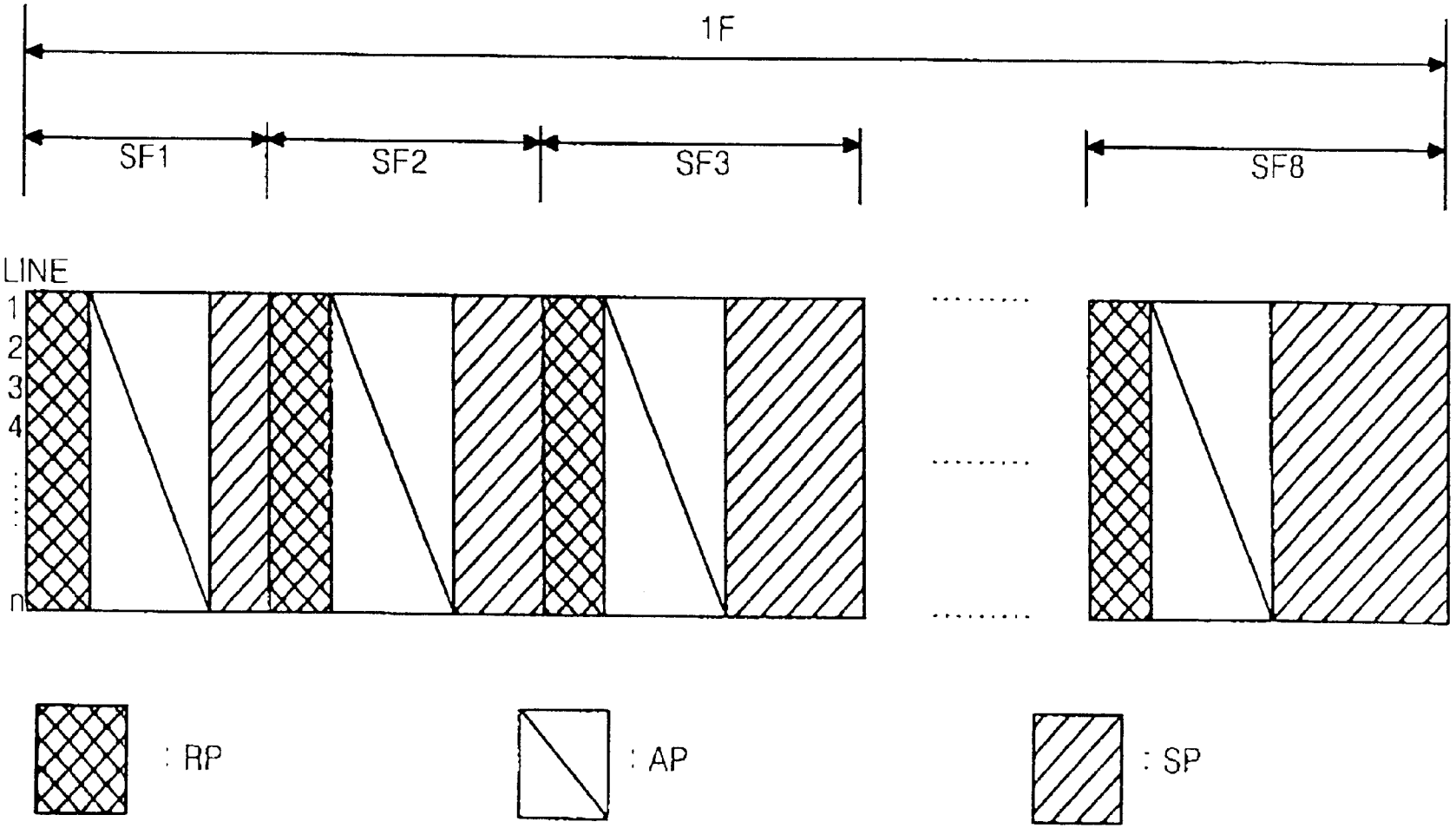
FIG. 2 PRIOR ART
FIG. 2 illustrates a configuration of one frame for providing a gray level display of the plasma display panel shown in FIG. 1.
Figure 3:
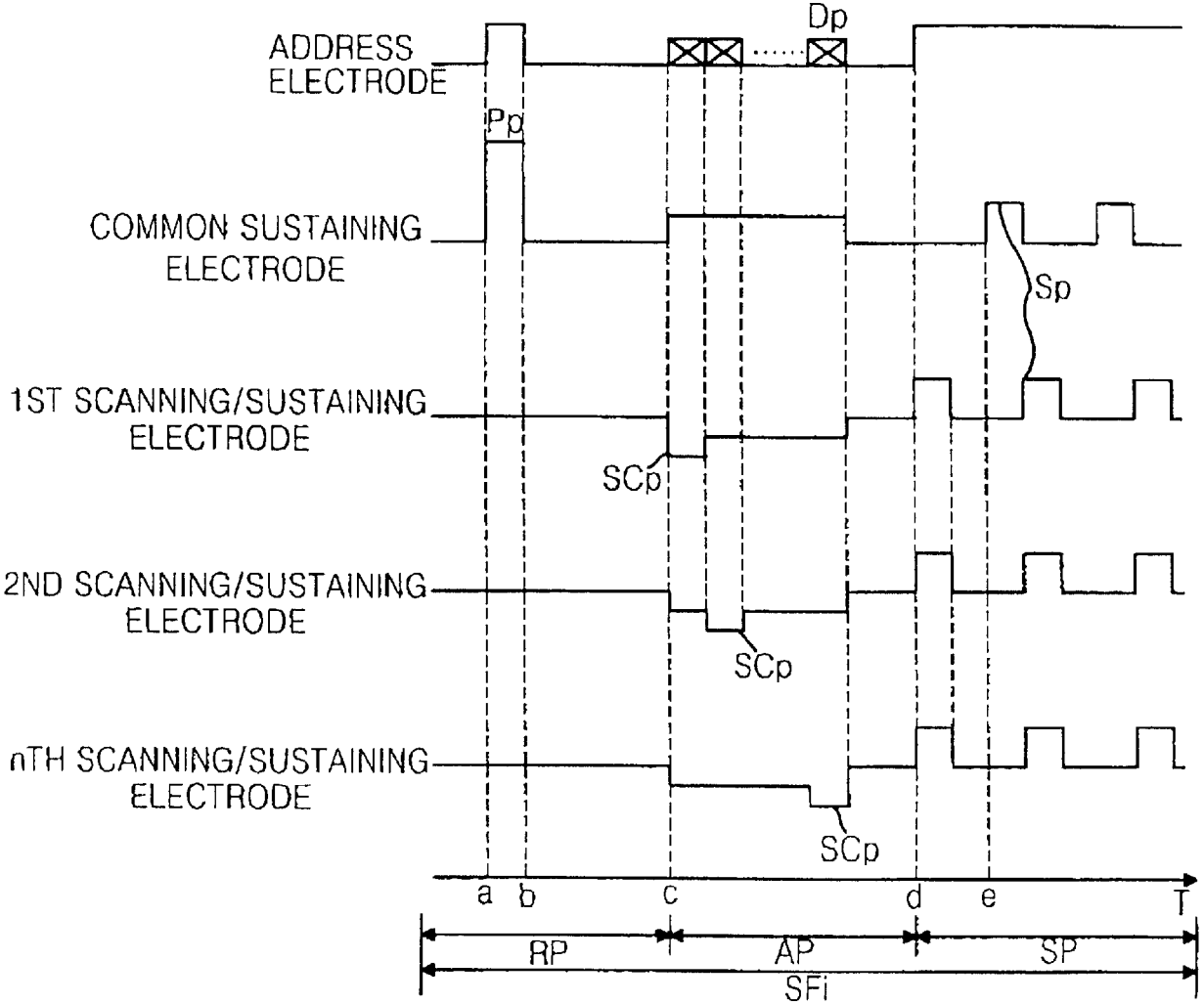
FIG. 3 PRIOR ART
FIG. 3 is waveform diagrams of driving signals applied to the plasma display panel during a certain sub-field interval shown in FIG. 2.
Figure 12:
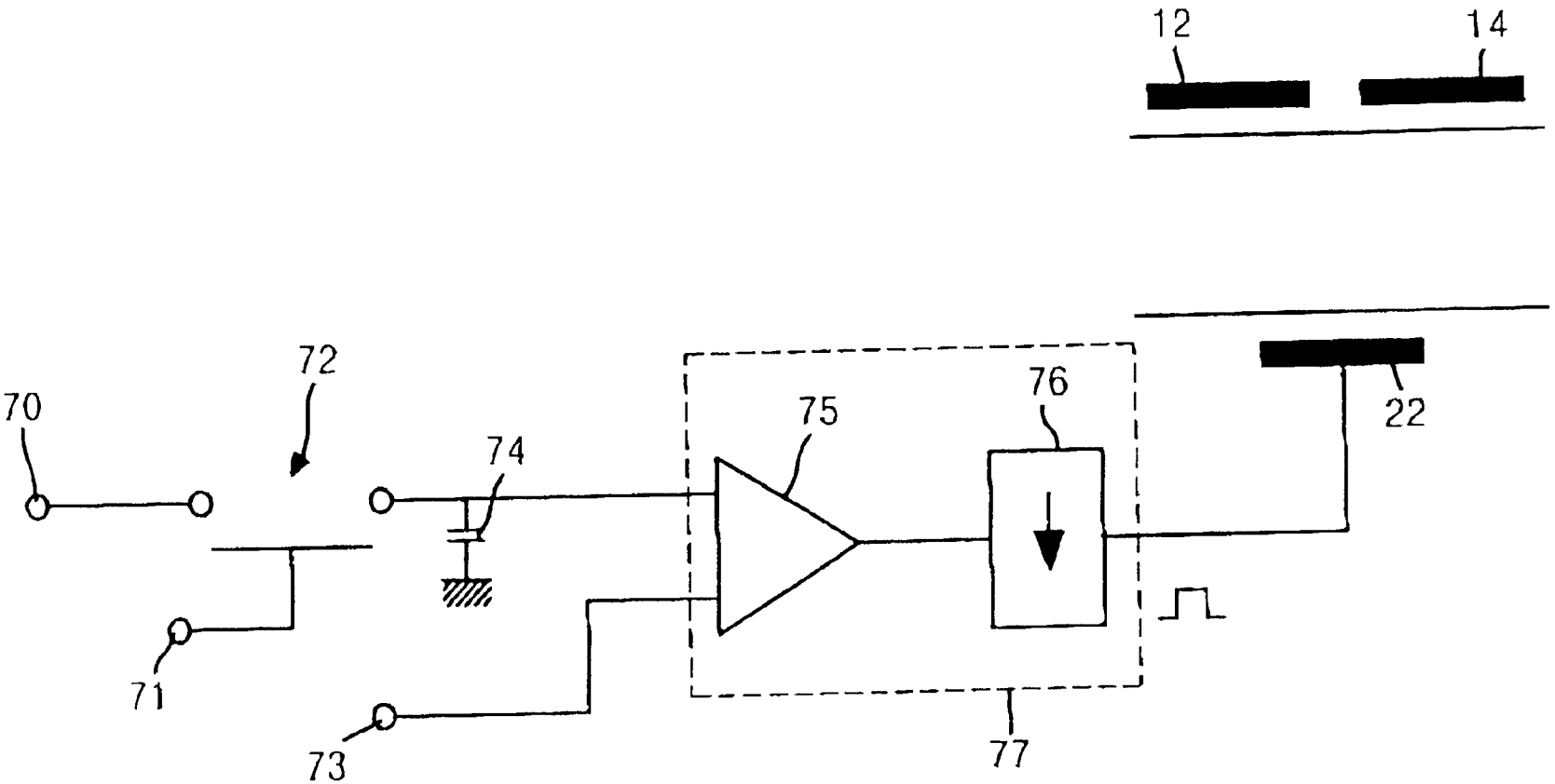
FIG. 12 is a circuit diagram of an address driving circuit included in a plasma display panel driving apparatus according to another embodiment of the present invention.

If a charge device for charging a video signal is provided with a driving circuit separated from the plasma display panel as shown in FIG. 12, the conventional plasma display panel of FIG. 1 can be driven by means of the analog video signal.

Referring to FIG. 12, there is shown an address driving circuit for generating an address pulse, which is used for starting a sustain discharge, at the time point corresponding to a voltage of video signal charged into a capacitor 74. The address pulse generated in the address driving circuit is applied to an address electrode 22. The address driving circuit of FIG. 12 includes: a switch 72 for switching an image signal (or a video signal) inputted via a first input line in accordance with a switching signal inputted via a second input line 71; the capacitor 74 for charging the image signal inputted via the switch 72; and an address voltage pulse generator 77 for generating an address voltage pulse to be applied to the address electrode 22, using reference voltage inputted via a third input line 73 and a voltage charged in the capacitor 74. The switch 72 responds to a switching signal, that is, a scanning signal inputted via the second input line 71 to sample an image signal inputted via the first input line 70 and then charge the same in the capacitor 74. The address voltage pulse generator 77 generates the address voltage pulse at the different timing in accordance with a voltage level of the image signal and applies the address voltage to the address electrode 22. In detail, the address voltage pulse generator 77 generates the address voltage pulse at the relatively earlier time when the voltage level of the image signal is higher. Meanwhile, if the voltage level of the image signal is lower, the address voltage pulse generator 77 generates the address voltage pulse at the relatively later timing. To this end, the address voltage pulse generator 77 is composed of a comparator 75 and a rectangular pulse generator 76. A reference voltage applied, via the third input line 73, to the comparator 75 increases or decreases with a lapse of time. The comparator 75 compares the reference voltage changed with a lapse of time with a voltage of the image signal stored in the capacitor 74 to output a voltage signal of high or low status. For example, the comparator 75 generates the voltage signal of low status when the voltage of the image signal charged into the capacitor 74 is higher than the reference voltage. Meanwhile, if the voltage of the image signal charged into the capacitor 74 is lower than the reference voltage, the comparator 75 outputs the voltage signal of the low status. The rectangular pulse generator 76 detects an edge of voltage signal from the comparator 75 and generates the address voltage pulse at the edge of the voltage signal from the comparator 75. The address voltage pulse generated in the comparator 75 is applied to the address electrode 22. When the address voltage pulse is applied to the address electrode 22, the sustain discharge initiates by a difference between the address voltage signal and a fire voltage pulse supplied to a pair of sustain electrodes 22 and 14. The sustain discharge maintains by a sustain voltage pulse applied repeatedly to the pair of the sustain electrodes 12 and 14. In the address voltage pulse generator having such a configuration, the address voltage signal is generated at the different timing in accordance with the voltage of the image signal. Accordingly, the sustain discharge continues during a time interval proportional to the voltage of the image signal, thereby implementing a gray scale display.

As described above, according to the present invention, after an address voltage corresponding to an analog video signal was charged in a charge device which is installed into each discharge cell or in the external, the discharge is sustained during a time interval proportional to a magnitude of the address voltage. Accordingly, one frame interval consists of once reset interval, once address interval and once discharge sustaining interval. As a result, when the driving method according to the present invention is compared with the conventional sub-field driving method driven with a digital data signal, it reduces the address interval into 1/n (wherein n represents the bit number of a data) and relatively lengthens the discharge sustaining interval, thereby improving the brightness dramatically. Furthermore, according to the present invention, a contour noise caused by a discontinuity of an emitting pattern from the conventional digital gray level realization is not generated. In addition, the emitting frequency in the reset interval is reduced to 1/n compared with the conventional sub-field driving method to decrease a black level, thereby improving the brightness. Particularly, the PDP according to the present invention can be driven with an analog video signal, so that a middle gray level having a difficulty in realization due to an increase in the number of sub-fields in the conventional sub-field driving method also can be expressed. Moreover, a gray level with more grades can be expressed when one frame consists of a plurality of sub-fields, so that a middle gray level can be expressed more distinctly.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel including a plurality of cells driven with an analog image signal, each of the cells in the plasma display panel comprising:

a sustaining electrode pair arranged in parallel for a sustaining discharge;

a charge device for charging an address voltage corresponding to the image signal to initiate the sustaining discharge along with any one electrode of the sustaining electrode pair; and a discharge space into which a discharge gas is injected to cause a gas discharge.

2. The plasma display panel as claimed in claim 1, wherein the discharge space is defined by a first substrate provided with the sustaining electrode pair, a second substrate provided with the voltage charge device and a barrier rib formed between the first and second substrates, and further comprising:

a first dielectric layer formed on the first substrate provided with the sustaining electrode pair; and a fluorescent material layer coated on at least one of the first and second substrates in such a manner to be exposed to the discharge space.

3. The plasma display panel as claimed in claim 1, wherein the charge device comprises:

an address electrode to which the address voltage pulse is applied;

a second dielectric layer formed on the second substrate provided with the address electrode; and an address auxiliary electrode formed on the second dielectric layer in such a manner to cross the address electrode and being independent from each other for each cell.

4. The plasma display panel as claimed in claim 1, wherein the charge device is closed to the first sustaining electrode supplied with a ground potential of the sustaining electrode pair by a plasma channel formed in the discharge space with the aid of a switching discharge between the sustaining electrode pair, and opened to the first sustaining electrode when the switching discharge has been completed to sustain the charge address voltage.

5. The plasma display panel as claimed in claim 4, wherein the address auxiliary electrode is exposed to the discharge space and arranged in parallel to the first sustaining electrode.

6. The plasma display panel as claimed in claim 1, wherein the voltage charged in the charge device increases proportionally to a voltage which is applied to have a level being high with a lapse of time after charging the address voltage, thereby initiating the sustaining discharge.

7. The plasma display panel as claimed in claim 6, wherein a firing voltage pulse for initiating the sustaining discharge and a sustaining voltage pulse for making the sustaining discharge are repetitively applied to the sustaining electrode pair during a specific period.

8. The plasma display panel as claimed in claim 1, wherein the sustaining electrode pair allows a reset discharge for initializing the cells and an erasure discharge for erasing a spurious wall charge to be more generated.

9. A method of driving a plasma display panel including a plurality of cells driven with an analog image signal, comprising:

an addressing step for charging an address voltage corresponding to the image signal into a charge device provided for each of said cells; and an automatic firing and sustaining discharge step for generating a sustaining discharge during a period proportional to an address voltage charged in the charge device.

10. The method as claimed in claim 9, further comprising:

a reset step for initializing the cells prior to the address step.

11. The method as claimed in claim 9, wherein the address step comprises:

forming a plasma channel in a discharge space by a switching discharge between a sustaining electrode pair included in each cell to short the charge device consisting of an address electrode, an address auxiliary electrode separated for each cell and a dielectric layer therebetwen to a first sustaining electrode of the sustaining electrode pair supplied with a ground potential, thereby charging the address voltage in the charge device; and maintaining the address voltage charged in the charge device opened to the first sustaining electrode by a termination of the switching device.

12. The method as claimed in claim 11, wherein the switching discharge is generated by a scanning voltage pulse applied to the second sustaining electrode of the sustaining electrode pair; and the address voltage is charged by an address voltage pulse applied to the address electrode upon formation of the plasma channel.

13. The method as claimed in claim 12, wherein the specific voltage has a shape of ramp wave.

14. The method as claimed in claim 12, wherein the specific voltage has a shape of stepwise wave.

15. The method as claimed in claim 11, further comprising:

a wall charge erasure interval for erasing a wall charge formed on the dielectric layer at the side of said sustaining electrode pair by the switching discharge.

16. The method as claimed in claim 11, wherein the automatic firing and sustaining discharge step comprises:

repetitively applying a firing voltage pulse for initiating the sustaining discharge and a sustaining voltage pulse for making the sustaining discharge to the sustaining electrode pair; and allowing a specific voltage applied to the address electrode while changing with the lapse of time to increase proportionally to the voltage charged in the charge device, thereby initiating a discharge when a voltage difference from any one electrode of the sustaining electrode pair goes into a discharge initiating voltage and sustaining the discharge during the corresponding period.

17. The method as claimed in claim 16, wherein the specific voltage is a voltage increasing or decreasing with the lapse of time.

18. The method as claimed in claim 16, wherein the firing voltage pulse has a lower level than the sustaining voltage pulse.

19. The method as claimed in claim 16, wherein the firing voltage pulse and the sustaining voltage pulse applied to the first sustaining electrode has the same polarity while the firing voltage pulse and the sustaining voltage pulse applied to the second sustaining electrode has a phase contrary to each other.

20. The method as claimed in claim 16, wherein the firing voltage pulse is simultaneously applied to the sustaining electrode pair, and the sustaining voltage pulse is applied to the sustaining electrode pair at a different time.

21. The method as claimed in claim 16, wherein one frame for one field display includes once address step and once automatic firing and discharge sustaining step.

22. The method as claimed in claim 16, wherein one frame for one field display consists a plurality of sub-fields including the address step and the automatic firing and discharge sustaining step.

23. The method as claimed in claim 22, wherein a period of the automatic firing and discharge sustaining step is set differently for each of the sub-fields.

24. The method as claimed in claim 22, wherein a period of the automatic firing and discharge sustaining step is set equally for each of the sub-fields.

25. A driving apparatus for a plasma display panel including a plurality of cells driven with an analog image signal, wherein each of the cells in the plasma display panel includes first and second sustaining electrodes, a charge device for charging an address voltage corresponding to the image signal to initiate the sustaining discharge along with any one electrode of the first and second sustaining electrodes, and a discharge space into which a discharge gas is injected to cause a gas discharge, said driving apparatus comprising:

a first sustaining driver for applying a firing voltage pulse for initiating the sustaining discharge and a sustaining voltage pulse for making the sustaining discharge to the first sustaining electrode;

a second sustaining driver for applying a scanning voltage pulse for a switching discharge, the firing voltage pulse and the sustaining voltage pulse to the second sustaining electrode; and an address driver for applying the address voltage pulse to an address electrode included in the charge device and for applying a specific voltage changing with the lapse of time to the address electrode when the firing voltage pulse and the sustaining electrode pulse are coupled.

26. The driving apparatus as claimed in claim 25, wherein the first sustaining driver further applies a reset voltage pulse for resetting the cells.

27. The driving apparatus as claimed in claim 25, wherein the first sustaining driver forms a plasma channel by the switching discharge during a period when the switching is being generated to apply a ground voltage to the first sustaining electrode shorted to the address auxiliary electrode, thereby charging the address voltage in the charge device.

28. The driving apparatus as claimed in claim 27, wherein the address driver applies the address voltage pulse at a time when the plasma channel is to be formed.

29. The driving apparatus as claimed in claim 25, wherein the second sustaining driver applies an erasure voltage pulse for erasing a wall charge formed on a dielectric layer at the sides of the first and second sustaining electrodes to the second sustaining electrode.

30. The driving apparatus as claimed in claim 25, wherein the erasure voltage pulse rises slowly and thereafter drops rapidly with the lapse of time so that the wall charge can be erased with no erasure discharge.

31. The driving apparatus as claimed in claim 25, wherein the first and second sustaining drivers applies the firing voltage pulse having a lower level than the sustaining voltage pulse.

32. The driving apparatus as claimed in claim 25, wherein the first sustaining driver applies the firing voltage pulse and the sustaining voltage pulse having the same polarity to the first sustaining electrode, whereas the second sustaining driver applies the firing voltage pulse and the sustaining voltage pulse having a polarity contrary to each other to the second sustaining electrode.

33. The driving apparatus as claimed in claim 25, wherein the first and second sustaining drivers applies the firing voltage pulse simultaneously to the first and second sustaining electrodes and applies the sustaining voltage pulse to the first and second sustaining electrodes at a different time.

34. The driving apparatus as claimed in claim 25, wherein the address driver applies a specific voltage increasing or decreasing with the lapse of time to the address electrode.

35. The driving apparatus as claimed in claim 34, wherein the specific voltage has a shape of ramp wave.

36. The driving apparatus as claimed in claim 34, wherein the specific voltage has a shape of stepwise wave.

37. A method of driving a plasma display panel including a plurality of cells using an analog image signal, comprising the steps of:

charging the analog image signal into a charge device;

generating an address voltage pulse at the different timing in accordance with a voltage charged into the charge device; and initiating and maintaining a sustaining discharge responding to the address voltage pulse.

38. The method as claimed in claim 37, wherein the address voltage pulse is generated at an edge of a signal produced by a comparing the voltage charged into the charge device with a reference voltage varied along with a lapse of time.

39. The method as claimed in claim 38, wherein the reference voltage is in one of increasing and decreasing with the lapse of time.

40. A driving apparatus for a plasma display panel including a plurality of cells using an analog image signal, comprising:

an address driving circuit including a charge device charging the image signal, the address driving circuit generating an address voltage pulse at a timing shifted with a voltage charged into the charge device and applying the address voltage pulse to an address electrode in each cell; and a sustain driving circuit for applying a fire voltage pulse and a sustain voltage pulse to a pair of sustain electrodes, the fire voltage pulse initiating a sustain discharge with the address voltage pulse, the sustain voltage pulse generating continuously the sustain discharge.

41. The driving apparatus as claimed in claim 40, wherein the address driving circuit includes:

sampling means for charging the image signal responding to a control signal from an external and for applying the sampled image signal to the charge device; and an address voltage pulse generating means for generating the address voltage pulse on the basis of a resultant which is produced by comparing the voltage charged into the charge device with a reference voltage varied along with a lapse of time.

42. The driving apparatus as claimed in claim 40, wherein the reference voltage is in one of increasing and decreasing with a lapse of time.

* * * * *